US009856073B2

(12) United States Patent
Perron et al.

(10) Patent No.: US 9,856,073 B2
(45) Date of Patent: Jan. 2, 2018

(54) HANGER SUPPORT

(71) Applicant: Technology Container Corporation, Worcester, MA (US)

(72) Inventors: Keith B. Perron, Methuen, MA (US); Kevin Reilly, Worcester, MA (US)

(73) Assignee: TECHNOLOGY CONTAINER CORP., Desoto, TX (US)

( * ) Notice: Subject to any disclaimer, the term of this patent is extended or adjusted under 35 U.S.C. 154(b) by 483 days.

(21) Appl. No.: 14/136,122

(22) Filed: Dec. 20, 2013

(65) Prior Publication Data

US 2014/0202896 A1 Jul. 24, 2014

Related U.S. Application Data

(60) Provisional application No. 61/739,811, filed on Dec. 20, 2012.

(51) Int. Cl.
*B65D 85/18* (2006.01)

(52) U.S. Cl.
CPC ..... *B65D 85/185* (2013.01)

(58) Field of Classification Search
CPC ..... B65D 85/185; B65D 85/18; A45C 3/004; A45C 13/03; A47G 25/54
USPC ..... 206/279, 278, 289, 290, 291; 211/123, 211/124; D9/631
See application file for complete search history.

(56) References Cited

U.S. PATENT DOCUMENTS 3,003,616 A * 10/1961 Field ..... B65D 85/185 206/279
3,037,617 A * 6/1962 Collin ..... B65D 85/185 206/279
3,270,865 A * 9/1966 Brennan ..... B65D 85/185 206/279
3,357,542 A * 12/1967 Aquino ..... B65D 85/185 206/279
4,811,853 A * 3/1989 Mead ..... B65D 85/185 206/279
6,568,545 B2 * 5/2003 Feder ..... A47F 7/24 206/291

OTHER PUBLICATIONS

Printout of http://ezcollegestorage.com/Products.php on Dec. 16, 2013.

* cited by examiner

*Primary Examiner* — Fenn C Mathew
*Assistant Examiner* — Cynthia Collado
(74) *Attorney, Agent, or Firm* — Kriegsman & Kriegsman

(57) ABSTRACT

A hanger support includes a unitary structure defining a set of panels comprising a center panel, a first end panel extending from the center panel along a first longitudinal direction, and a second end panel extending from the center panel along a second longitudinal direction, the second longitudinal direction opposing the first longitudinal direction. The hanger support includes a first hinge joint disposed between the first end panel and the center panel, a second hinge joint disposed between the second end panel and the center panel and at least one set of openings defined by the center panel extending through a first planar surface and a second planar surface of the unitary structure, the at least one set of openings configured to receive a hook of a hanger.

10 Claims, 10 Drawing Sheets

HANGER SUPPORT

RELATED APPLICATIONS

This patent application claims the benefit of U.S. Provisional Application No. 61/739,811, filed on Dec. 20, 2012, entitled, "Clothes Hanger Support Structure," the contents and teachings of which are hereby incorporated by reference in their entirety.

BACKGROUND

Conventional garment boxes can include a hanger support element which allows garments such as shirts, dresses, jackets, skirts, and pants to be suspended within the box via a clothes hanger. In one arrangement, with reference to FIG. 1, a conventional hanger support element 10 is configured to mount to a corresponding garment box to maintain the garments therein. For example, the hanger support element 10 can include a rod 12 having a first end 16 and a second end 18. The first end 16 of the rod 12 includes a wall mounting apparatus 14 disposed thereon. The wall mounting apparatus 14 can define a substantially U-shaped channel 22 configured to interact with a wall of a garment box 20.

To install the hanger support element 10 onto the garment box 20, an installer inserts a portion of the first wall 24 into the U-shaped channel 22 of the wall mounting apparatus 14. The installer then inserts the second end 18 of the hanger support element 10 into an opening or cutout 26 defined by a second, opposing wall 28 of the garment box 20. Interaction of the wall mounting apparatus 14 with the first wall 24 and interaction of the second end 18 of the rod 12 with the cutout 26 maintains the hanger support element 10 within the garment box 20 in the position shown. Accordingly, the hanger support element 10 is configured to support a hanger and an associated article of clothing within the garment box 20.

SUMMARY

Conventional hanger support elements suffer from a variety of deficiencies. For example, with reference to FIG. 1, the cutout 26 within the second wall 28 of the garment box 20 is sized to support the second end 18 of the hanger support element 10. However, conventional the garment boxes 20 are manufactured from corrugated cardboard. Over time, the weight of a garment hanging from the hanger support element 10 along can cause the second end 18 of the rod 12 to deform the corrugated cardboard wall 28 that defines the cutout 26. Additionally, in the case where the garment box 20 is transported between locations, movement of the garment box 20 can cause the second end 18 of the rod 12 to wear away the corrugated cardboard wall 28 that defines the cutout 26. In either case, damage to the cutout location can allow the second end 18 of the rod 12 to loosen and slip from the cutout 26, thereby causing the garments carried by the garment box 20 to fall to the bottom and become wrinkled.

By contrast to conventional hanger support elements, embodiments of the present innovation relate to a hanger support configured to carry one or more hangers, such as garment hangers, in a container such as a garment container. In one arrangement, the hanger support is configured as a generally thin, flat, and elongated unitary structure having three longitudinally aligned panels including a center panel and two end panels extending from opposing ends of the center panel. The center panel of the hanger support defines a set of openings that extends through the thickness of the support and that is configured to accept a hook of a clothes hanger. The hanger support is configured to interact with the garment container to maintain the clothes hanger within the container in a secure manner. For example, the outer panels fit through openings defined by opposing walls of the garment container to dispose the center panel and clothes hanger between the opposing walls. With such positioning, a first end panel of the hanger support is secured to a front wall of the garment container, opposing cover elements or flaps of the garment container are folded in place onto the center panel, a second end panel of the hanger support is folded onto the cover flaps, and the second end panel is then secured to the cover flaps.

With such positioning, because the cover flaps are captured between the center panel and the second end panel of the hanger support, the hanger support distributes the load of the clothes hanger and the associated garment across a relatively large area. Such load distribution minimizes the ability for the weight of the garment to compress or crush the garment container walls at the support mounting site. Further, because the first and second end panels are secured to the garment container, the hanger support is configured to substantially maintain the positioning of a garment within the garment container, such as during shipping. This minimizes the possibility for the garment to become wrinkled or damaged when stored within the container.

In one arrangement, a hanger support includes a unitary structure defining a set of panels comprising a center panel, a first end panel extending from the center panel along a first longitudinal direction, and a second end panel extending from the center panel along a second longitudinal direction, the second longitudinal direction opposing the first longitudinal direction. The hanger support includes a first hinge joint disposed between the first end panel and the center panel, a second hinge joint disposed between the second end panel and the center panel, and at least one set of openings defined by the center panel extending through a first planar surface and a second planar surface of the unitary structure, the at least one set of openings configured to receive a hook of a hanger.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

Embodiments of the present innovation relate to a hanger support configured to carry one or more hangers, such as a garment hanger, in a container such as a garment container. In one arrangement, the hanger support is configured as a generally thin, flat, and elongated unitary structure having three longitudinally aligned panels including a center panel and two end panels extending from opposing ends of the center panel. The center panel of the hanger support defines a set of openings that extends through the thickness of the support and that is configured to accept a hook of a clothes hanger. The hanger support is configured to interact with the garment container to maintain the clothes hanger within the container in a secure manner. For example, the outer panels fit through openings defined by opposing walls of the garment container to dispose the center panel and clothes hanger between the opposing walls. With such positioning, a first end panel of the hanger support is secured to a front wall of the garment container, opposing cover flaps of the garment container are folded in place onto the center panel, a second end panel of the hanger support is folded onto the cover flaps, and the second end panel is then secured to the cover flaps.

Figure 1:
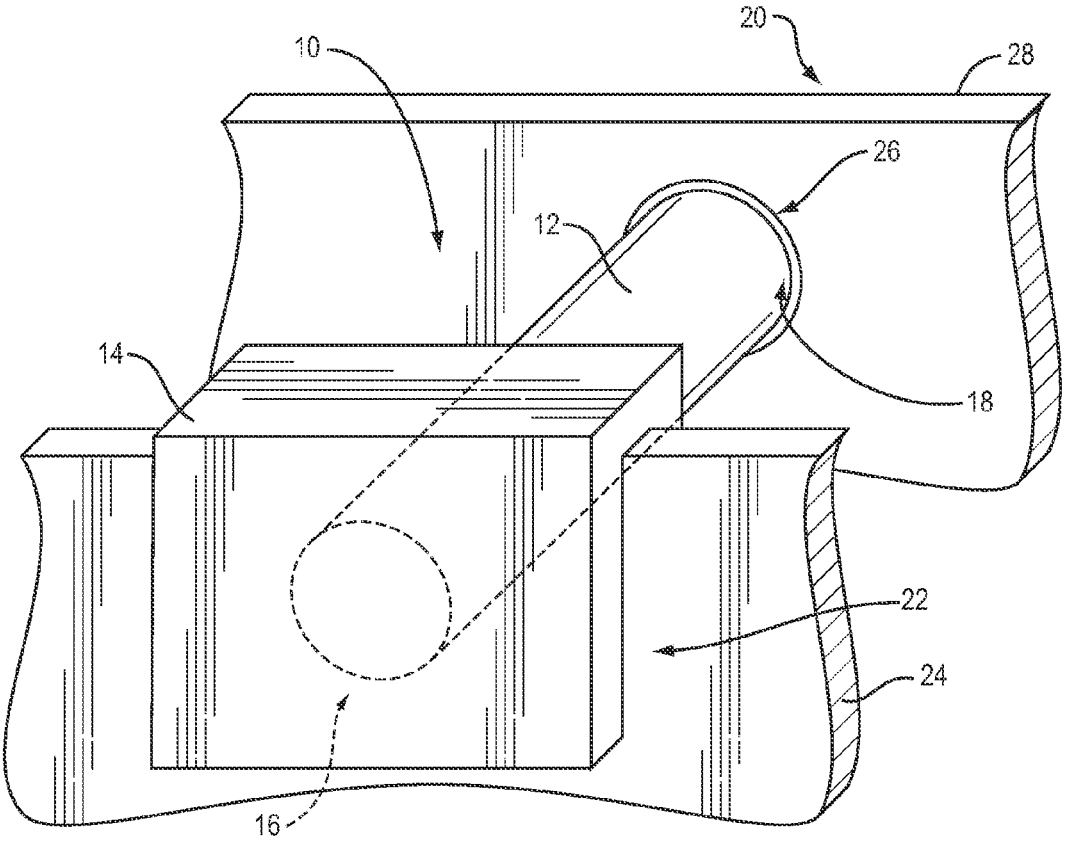
FIG. 1 (PRIOR ART)
FIG. 1 illustrates a prior art hanger support element.
Figure 2:
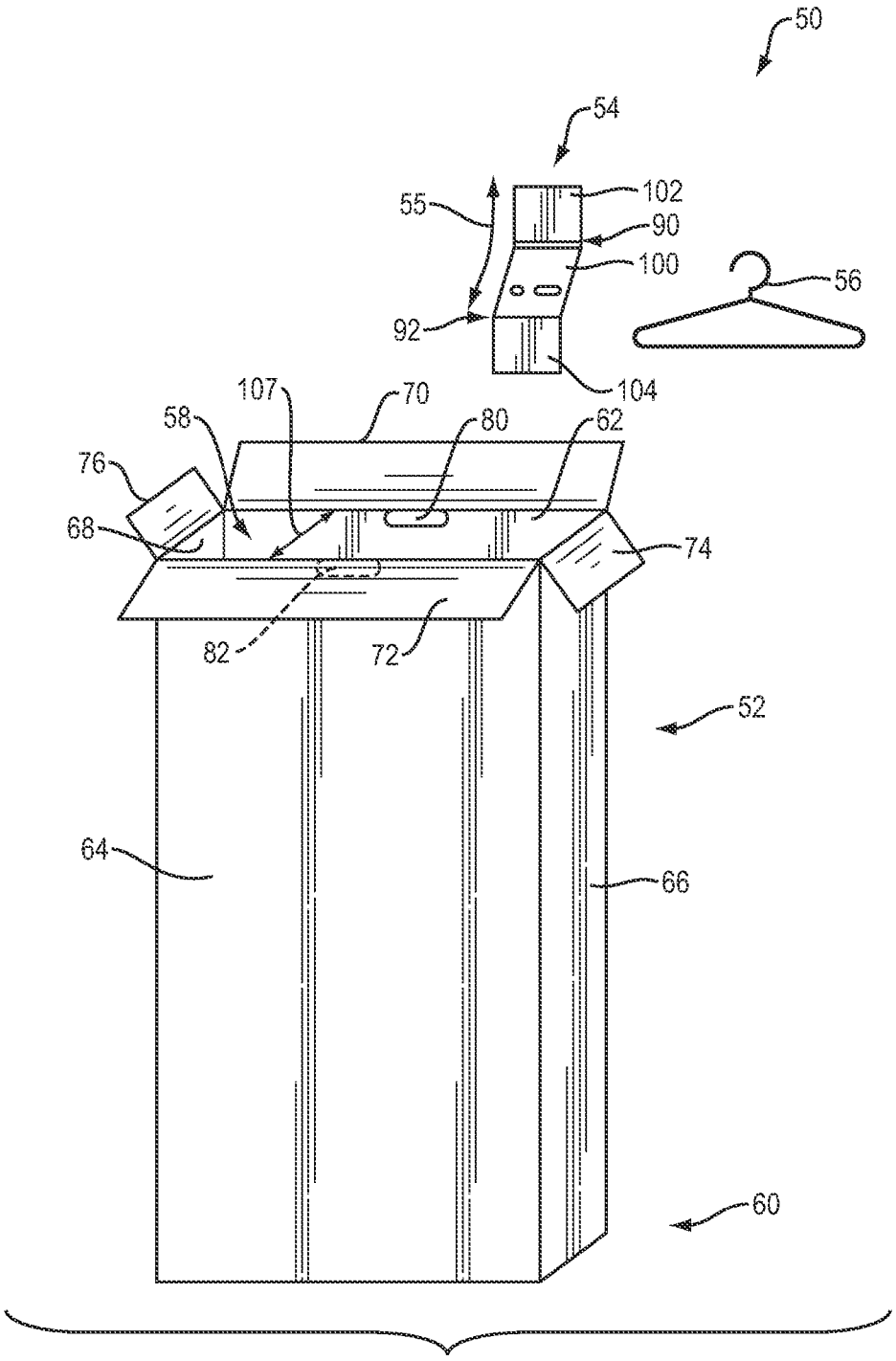
FIG. 2 illustrates an exploded view of a garment hanger system having a garment container and a garment hanger support, according to one arrangement.

FIG. 2 illustrates an exploded view of a hanger system 50, according to one arrangement. The hanger system 50 includes a container 52 and a hanger support 54 configured to carry one or more hangers 56, such as a garment hanger.

The container 52, in one arrangement, defines a volume 58 sized and shaped to contain an item, such as a garment. For example, the container 52 includes a base 60 and four walls, including opposing first and second walls 62, 64 and opposing third and fourth walls 66, 68, extending from the base 60. The container 52 further includes a cover element or flap extending from each of the four walls. For example, the container 52 includes first and second cover elements 70, 72 extending from the first and second walls 62, 64 and third and fourth cover elements 74, 76 extending from the third and fourth walls 66, 68. While the container 52 can be manufactured from a variety of materials, in one arrangement, the container 52 is manufactured from a corrugated cardboard material.

The container 52 is configured to interact with the hanger support 54 to maintain the general positioning of the hanger 56 within the volume 58. For example, the container 52 defines openings in proximity to the first and second cover elements 70, 72 which are configured to receive portions of the hanger support 54, as will be described in detail below. For example, the first wall 62 and the first cover element 70 of the container 52 defines a first opening 80 and the second wall 64 and the second cover element 72 of the container 52 defines a second opening 82 that opposes the first opening 80. While the openings 80, 82 can be configured with a variety of geometries, in one arrangement, each of the openings 80, 82 are configured as slot-shaped openings.

The hanger support 54 is configured with a length and width that accommodates containers 52 of varying sizes and that allows the hanger support 54 to carry one or more hangers as needed. For example, the hanger support 54 can have a length of between about 7 inches and 21 inches and a width of between about 4 inches and six inches and can be configured to carry between one and four hangers 56.

In one arrangement, the hanger support 54 is configured as a substantially flat and elongated unitary structure constructed and arranged to bend along hinge joints 90, 92, as will be described below. The hanger support 54 can be manufactured from a variety of materials. For example, the hanger support 54 can be manufactured, such as via a die cutting process, from a corrugated plastic material, a sheet plastic material, or a thin metal material. Alternately, the support can be manufactured using a molding process or other forming operations. In one arrangement, the hanger support 54 is configured as a substantially thin structure. For example, in the case where the support is manufactured from a corrugated polypropylene material, the hanger support 54 has a thickness of about three millimeters. The material configuration and substantially minimal thickness of the hanger support 54 minimizes the weight of the hanger support 54 and provides the hanger support 54 with sufficient structural integrity to carry one or more hangers 56, as described below. For example, as indicated in FIG. 3B, in the case where the hanger support 54 is manufactured from a corrugated polypropylene material, corrugations in the material extend along a longitudinal axis 55 to maximize support strength.

Figure 3A:
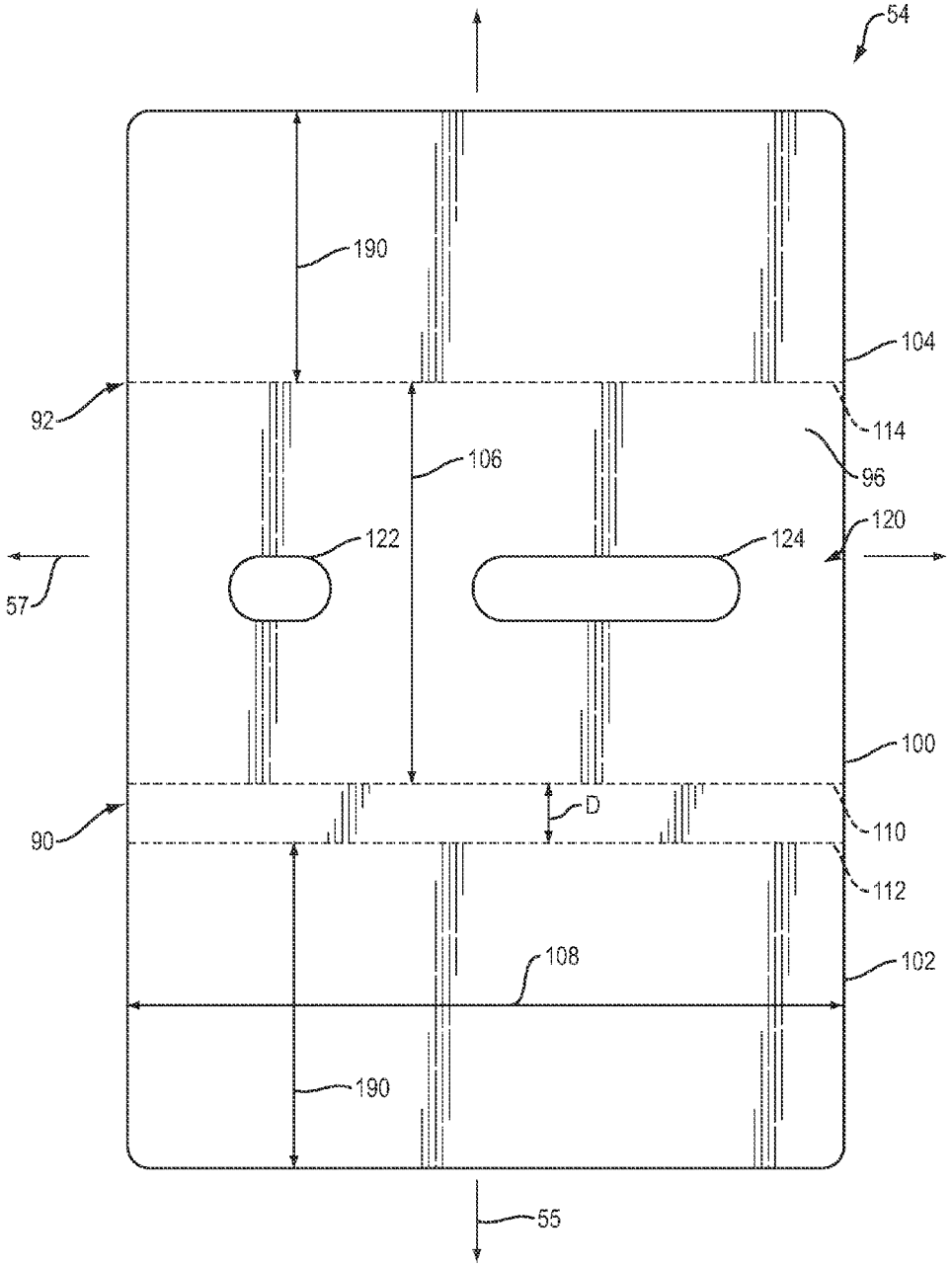
FIG. 3A illustrates a top view of the hanger support of FIG. 2, according to one arrangement.
Figure 3B:
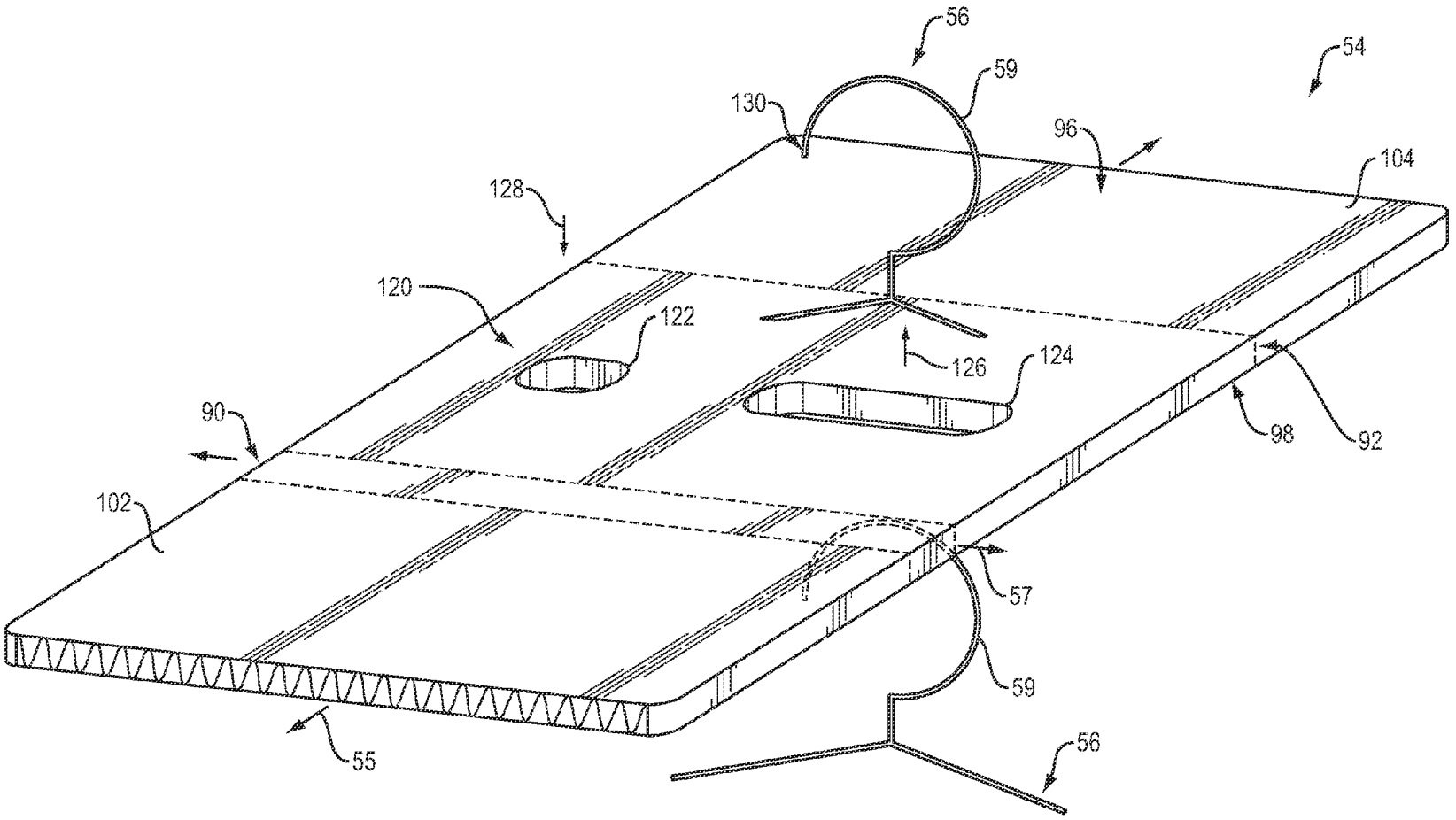
FIG. 3B illustrates a perspective view of the garment hanger support of FIG. 3A.

FIGS. 3A and 3B illustrate an example arrangement of the hanger support 54. As illustrated, the support 54 has a generally parallel first or top planar surface 96 and an opposing, generally flat bottom planar surface 98. The unitary structure of the hanger support 54 defines a set of longitudinally aligned panels including a center panel 100, a first end panel 102 extending from the center panel 100 along a first longitudinal direction, and a second end panel 104 extending from the center panel 100 along a second longitudinal direction which opposes the first longitudinal direction.

Each of the panels can be configured with a variety of lengths and widths. In one arrangement, the center panel 100 can have a length 106 that corresponds to an opening width 107 of the container 52, as illustrated in FIG. 2. For example the center panel 100 can have a length 106 of three inches for a three inch wide container 52 or a length 106 of five inches for a five inch wide container 52. In another example, with continued reference to FIGS. 2 and 3A, the first and second end panels 102 can each have a width 108 that corresponds to a width of the first and second openings 80, 82, respectively, of the container 52. For example, the first and second end panels 102 can each have a width 108 of four inches for four inch wide first and second opening 80, 82 or can each have a width of 5.5 inches for a 5.5 inch wide first and second opening 80, 82.

Returning to FIGS. 3A and 3B, as indicated above, the hanger support 54 is configured to bend along hinge joints 90, 92. For example, as illustrated, the first and second end panels 102, 104 are each separated from the center panel 100 by the hinge joints 90, 92. Each of the hinge joins 90, 92 can be manufactured using a variety of techniques. In one arrangement, the hinge joints 90, 92 can be created by scoring or crushing a portion of the hanger support 54 during a die stamping process to weaken the material and allow the panels 100, 102, 104 to flex relative to each other. For example, in the case where the support structure 54 is manufactured from a corrugated material having corrugations extending substantially along the longitudinal axis 55, the hinge joints 90, 92 are configured with a set of serrations extending along a vertical axis 57 and which are substantially orthogonal to the longitudinal axis of the corrugations.

The hinge joints 90, 92 can be configured in a variety of ways. For example, in one arrangement, the first hinge joint 90 is configured as a matchbook score having a first fold joint 110 and a second fold joint 112. As illustrated the first fold joint 10 is substantially parallel to the second fold joint 112 and is spaced at a distance D from the second fold joint 112. The distance D is sized such that when the first end panel 102 is folded about the first and second fold joints 110, 112 over the center panel 100, the first end panel 102 and the center panel 100 can capture and secure folded first and second cover elements 70, 72 of the container 52 there between. In one arrangement, the second hinge joint 92 is configured as a single fold joint 114 which allows the second end panel 104 to be folded down along the first wall 62 of the container 52.

The center panel 100 is configured to accept and carry a hook 59 of the hanger 55. For example, the center panel 100 defines a set of openings 120 that extending through the first planar surface 96 and the second planar surface 98 of the hanger support 54.

In one arrangement, the set of openings 120 includes a first opening 122 and a second opening 124, the first opening 122 being spaced at a distance from the second opening 124. In one arrangement, the openings 122, 124 are each at least as large as a diameter of the hook 59 of the hanger 56, which is typically wire or plastic, and the openings 122, 124 are spaced apart a sufficient distance such that the hanger 56 can hang from center panel 100, such as shown in FIG. 4.

The openings can be configured with a variety of geometries. For example, with reference to FIG. 3A and 3B, the first opening 122 is configured as a substantially circular opening while the second opening 124 is configured as an elongated slot, the elongated slot being elongated along the vertical axis 57 of the hanger support 54. Such a configuration allows a user to thread a hanger hook 59 through the center panel 100. For example, with reference to FIG. 3B, a user inserts the hook 59 into the slot 124 along direction 126. Once the hook 59 is disposed on a first side of the hanger support 54, the user moves the hanger 56 along direction 128 to dispose a distal end 130 of the hanger 56 into the first opening 122 which interlaces the hook 59 of the hanger 56 with the hanger support 54.

Figure 4:
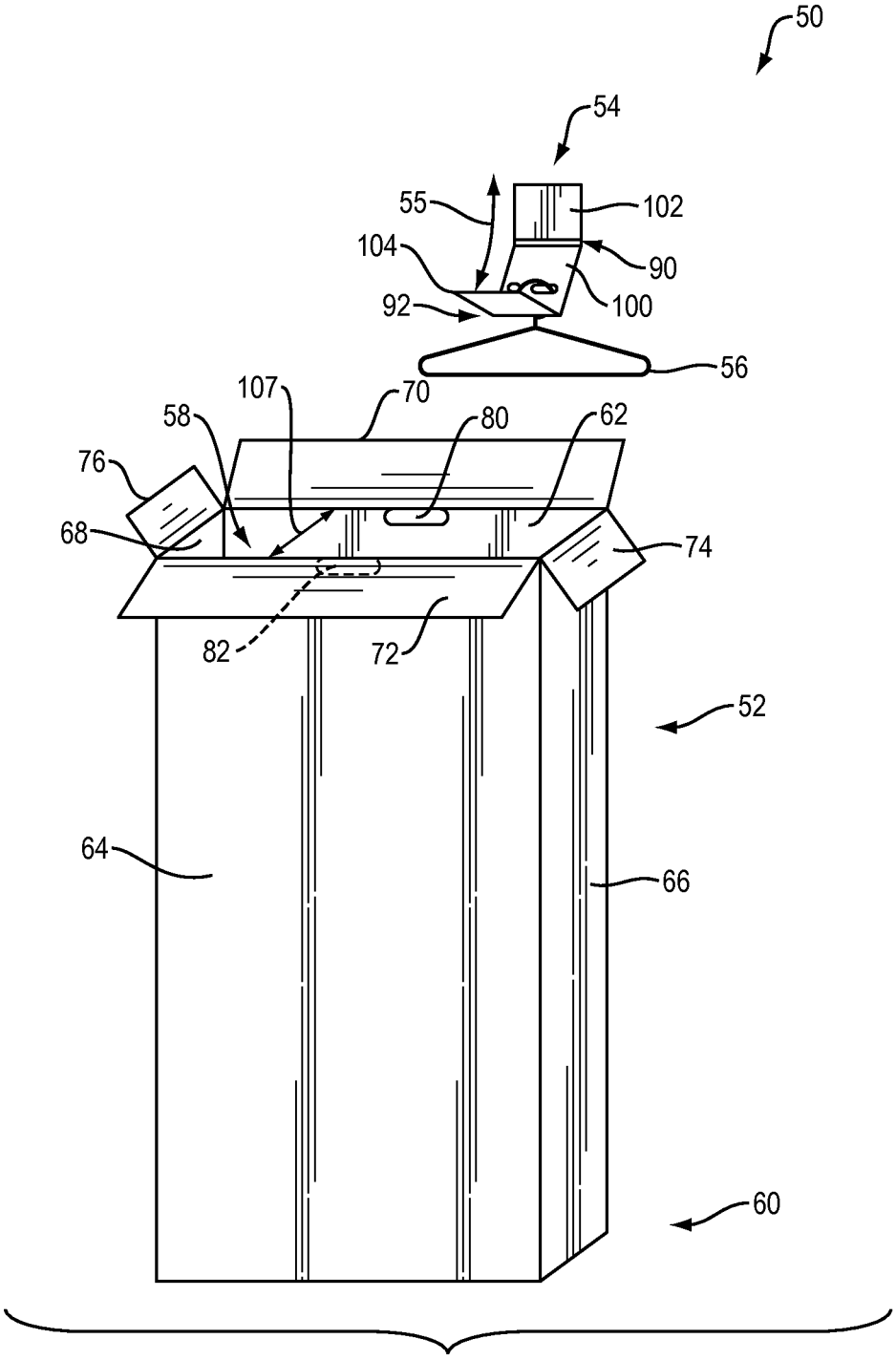
FIG. 4 illustrates an assembly step associated with assembling the garment hanger system of FIG. 2, according to one arrangement.
Figure 5:
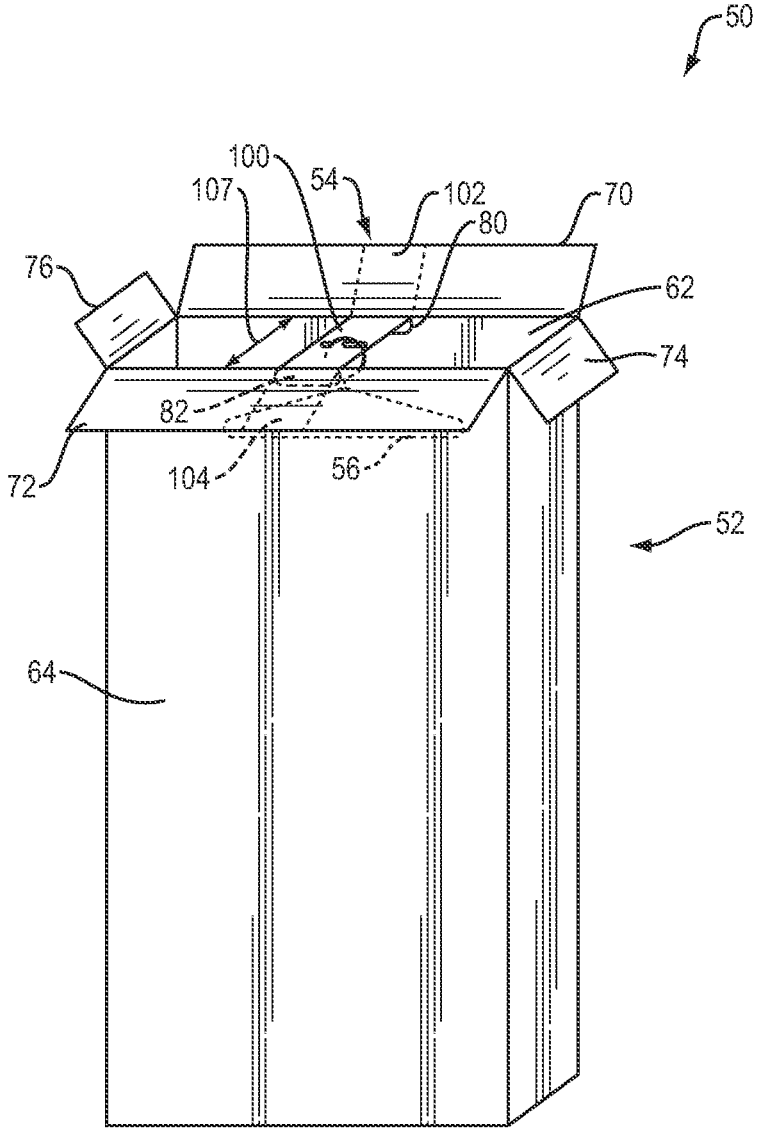
FIG. 5 illustrates an assembly step associated with assembling the garment hanger system of FIG. 2, according to one arrangement.

FIGS. 4 through 8 illustrate an example of an assembly procedure to assemble the container 52 and hanger support 54 into a hanger system 50. During an assembly procedure, an assembler disposes the hanger 56 onto the center panel 100 of the hanger support 54, as illustrated in FIG. 4 and described above.

Next, the assembler engages the hanger support 54 with the container 52 such that the hanger support 54 holds the hanger 56 and an associated article suspended within the volume 58. For example, with reference to FIG. 5, the assembler inserts the first end panel 102 into the first opening 80 in the first wall 62 where the first cover element 70 is disposed. The assembler then inserts the second end panel 104 into the second opening 82 in the second wall 62 where the second cover element 72 is disposed. Such assembly disposes the center panel 100 across a length 107 of a top portion of the container 52.

Figure 6:
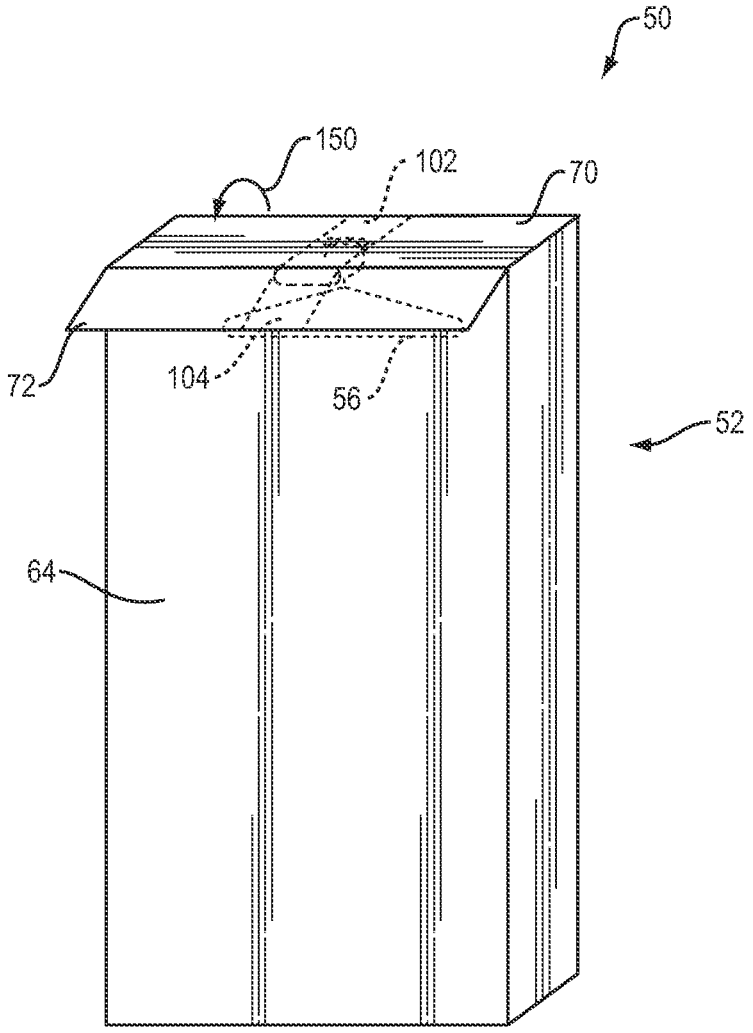
FIG. 6 illustrates an assembly step associated with assembling the garment hanger system of FIG. 2, according to one arrangement.
Figure 8:
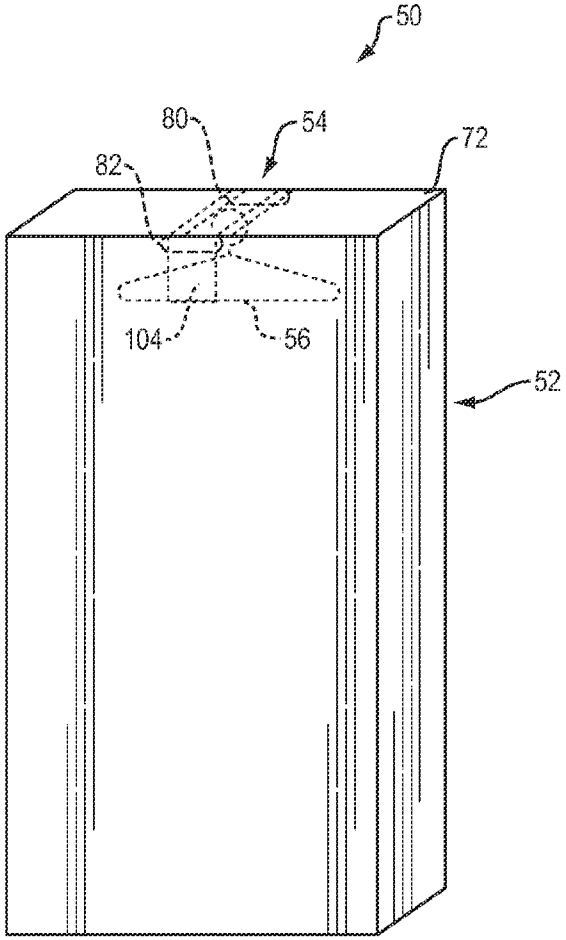
FIG. 8 illustrates an assembly step associated with assembling the garment hanger system of FIG. 2, according to one arrangement.
Figure 7:
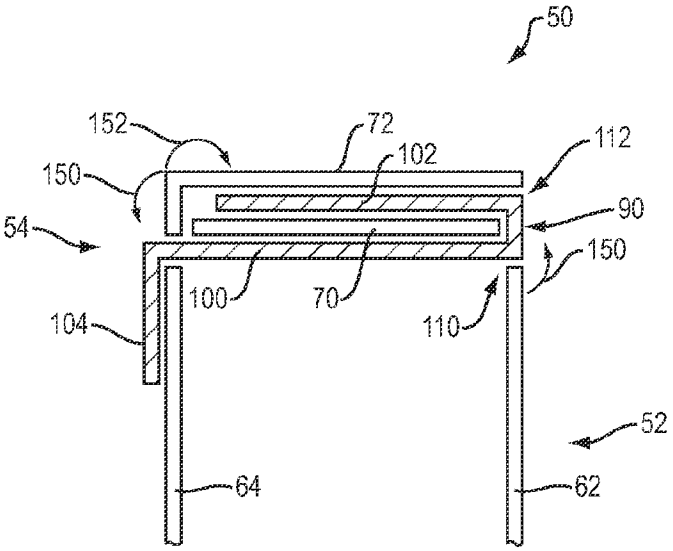
FIG. 7 illustrates a side sectional view of the garment container and a garment hanger support, according to one arrangement.

Next, as illustrated in FIGS. 6 and 7, the assembler rotates the second end panel 104 along a first direction 150 against the wall 64 of the container 52 and secures the second end panel 104 to the container, such as with an adhesive or tape, to hold the support 54 in place. FIG. 8 illustrates the second end panel 104 folded against the wall 64.

Returning to FIGS. 6 and 7, the assembler then folds the third and fourth cover elements 74, 76 toward the center of the container 52 and folds the first cover element 70 along direction 150 toward the center of the container 52 and over the center panel 100. As best illustrated in FIG. 7, the assembler then folds the first end panel 102 toward the center of the container 52 along the first direction to overlap the first cover element 70 and to capture the first cover element 70 there between. Accordingly, the spaced hinge joints 110, 112 accommodate the thickness of the first cover element 70. As indicated above, the first end panel 102 is constructed and arranged to fold back over the center panel 100 and typically has a length that is sufficient to at least cover the hanger openings 120 once it is folded over, to help to prevent the hangers 56 from becoming dislodged from the support 54 when the container 52 is moved.

With continued reference to FIG. 7, the assembler then rotates the second cover element 72 about a second direction 153 to cover the first end panel 102 and secures the container 52 closed. For example, tape can be placed over the second cover element 72, to secure the cover element 72 to the container 52 and to inhibit the first end panel 102 from moving or unlocking during transport. FIG. 8 illustrates the second cover element 72 folded onto the first end panel 102. The resulting hanger system 50 provides a closed container having a hanger 56 hanging in about the center of the container volume 58.

With such positioning, the hanger support 54 distributes the load of the hanger 56 and the associated garment across a relatively large area. Such load distribution minimizes the ability for the weight of the garment to compress or crush the garment container walls 62, 63 at the support mounting site. Further, because the first and second end panels 102, 104 are secured to the container 52, the hanger support 54 is configured to substantially maintain the positioning of a garment within the container 52, such as during shipping. This minimizes the possibility for the garment to become wrinkled or damaged when stored within the container 52.

While various embodiments of the innovation have been particularly shown and described, it will be understood by those skilled in the art that various changes in form and details may be made therein without departing from the spirit and scope of the innovation as defined by the appended claims.

Figure 9:
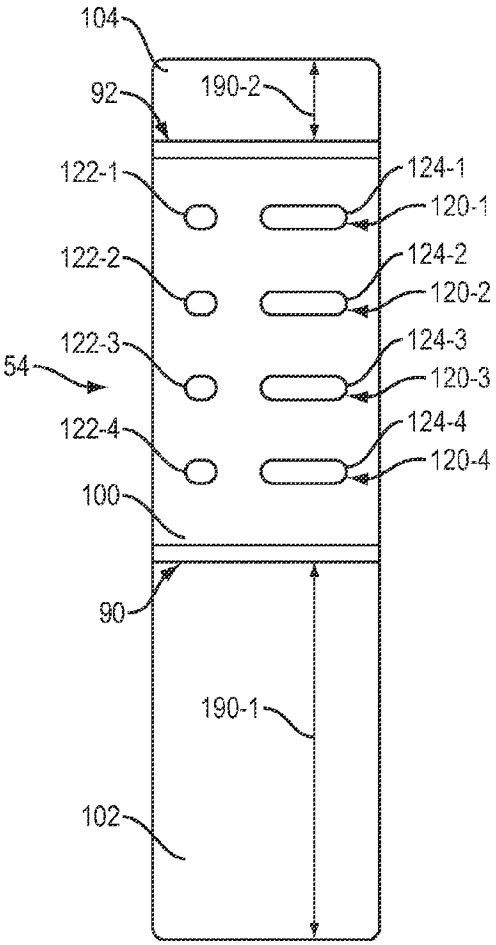
FIG. 9 illustrates a top view of a hanger support, according to one arrangement.

For example, as indicated above, the first hinge joint 90 of the hanger support 54 is configured as a matchbook score having a first fold joint 110 and a second fold joint 112 and the second hinge joint 92 is configured as a single fold joint 114. Such description is by way of example only. In one arrangement, as illustrated in FIG. 9, both the first hinge joint 90 and the second hinge joint 92 are configured as a matchbook score. Alternately, both the first hinge joint 90 and the second hinge joint 92 are configured as a single fold joint (not shown).

In another example, as indicated above, the center panel 100 defines a single set of openings 120 that extending through the first planar surface 96 and the second planar surface 98 of the hanger support 54 where the set of openings 120 includes a first opening 122 and a second opening 124. With such a configuration, the hanger support 54 is configured to carry a single hanger 56. Such description is by way of example only. In one arrangement, the center panel 100 defines multiple sets of openings to accept the hooks of multiple hangers. For example, as illustrated in FIG. 9, the center panel 100 defines four sets of openings 120-1 through 120-4 where the first set includes openings 122-1 and 124-1, the second set includes openings 122-2 and 124-2, the third set includes openings 122-3 and 124-3, and the fourth set includes openings 122-1 and 124-1. With such a configuration, the hanger support 54 is configured to carry up to four hangers 56.

Figure 10:
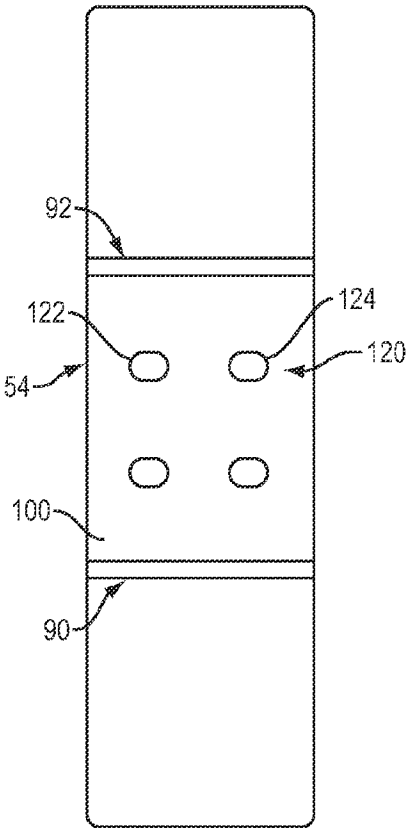
FIG. 10 illustrates a top view of a hanger support, according to one arrangement.

In another example, as indicated above, the first opening 122 is configured as a substantially circular opening while the second opening 124 is configured as an elongated slot, the elongated slot being elongated along the vertical axis 57 of the hanger support 54. Such description is by way of example only. In one arrangement, with reference to FIG. 10, the center panel 100 defines the first opening 122 and the second opening 124 with substantially similar geometries, such as circular geometries. Additionally, as illustrated in FIG. 10, the center panel 100 can define multiple sets of circular openings 87 to allow the hanger support 54 to carry multiple hangers 56.

In another example, as indicated in FIGS. 3A and 3B, the first and second end panels 102, 104 are configured as having substantially equal lengths 190. Such illustration is by way of example only. In one arrangement, as illustrated in FIG. 9, the first and second end panels 102, 104 are configured with different lengths 190-1, 190-2. For example, in the case of the second end panels 104, the second end panel 104 is configured with a length that is sufficient to allow the panel 104 to be secured (e.g. taped) to the outside wall 64 of the container 52 and the first end panel 102 is configured with a length 190-2 that is substantially equal to the length of the center panel 100 to cover the set of openings 120. Accordingly, as illustrated the length 190-2 of the second end panel 104 can be shorter than the length 190-1 of the first end panel 102.

As indicated above, the first end panel 102 is constructed and arranged to fold back over the center panel 100 and typically will have a length that is sufficient to at least cover the hanger openings 120 once it is folded over, to help to prevent the hangers 56 from becoming dislodged from the hanger support 54 when the container 52 is moved. However, in one arrangement, since the first and second cover elements 70, 72 typically overlie the center panel 100 to secure the hangers 56, additional overlying by first end panel 102 may not be necessary. Accordingly, the first and second end panels 102, 104 can be folded in opposing directions against the opposing first and second walls 62, 64 of the container 52. Alternately, the first and second end panels 102, 104 can be folded in opposing directions against the cover elements 70, 72 (i.e., over the top) of the container 52.

Figure 11:
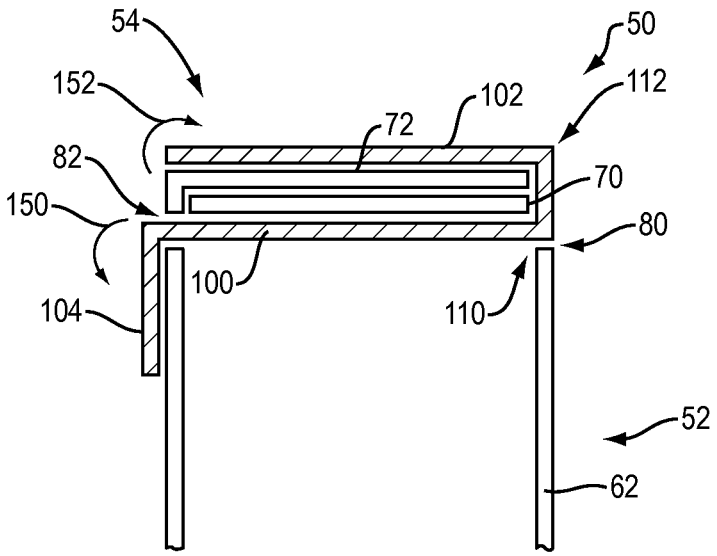
FIG. 11 illustrates a side sectional view of the garment container and a garment hanger support, according to one arrangement.

As indicated above, during the assembly process an assembler folds a first end panel 102 of the support 54 toward the center of the container 52 and along the first direction to overlap the first cover element 70 and to capture the first cover element 70 there between. The assembler then rotates the second cover element 72 about a second direction 152 to overlap the first end panel 102. Such description is by way of example only. FIG. 11 illustrates the results of an alternate assembly process. As illustrated, after installing the support 54 within the container 52, the assembler rotates the first cover element 70 along the first direction 150 to overlap the center panel 100 and rotates the second cover element 72 along a second direction to overlap the first cover element 70. Next, the assembler rotates the first end panel 102 about the first and second fold joints 110, 112 to overlap at least a portion of the second cover element 72. As shown, the spaced hinge joints 110, 112 accommodate the thickness of the first cover element 70 and the second cover element 72. The assembler then secures the first end panel 102 and the first and second cover elements 70, 72 to the container 52.

What is claimed is:

1. A garment hanger system, comprising:

a garment container comprising a base, opposing first and second walls, and opposing third and fourth walls, the container being shaped to define first and second slot-shaped openings; and a hanger support coupled to the garment container, the hanger support comprising:

a generally thin, flat and elongated unitary structure defining a set of longitudinally aligned planar panels comprising a planar center panel, a planar first end panel extending from the center panel along a first longitudinal direction, and a planar second end panel extending from the center panel along a second longitudinal direction, the second longitudinal direction opposing the first longitudinal direction, a first hinge joint disposed between the first end panel and the center panel, a second hinge joint disposed between the second end panel and the center panel, the center panel having a length from the first hinge joint to the second hinge joint, and at least one set of openings defined by the center panel extending through a first planar surface and a second planar surface of the unitary structure, the at least one set of openings configured to receive a hook of a hanger;

wherein the first end panel is dimensioned to fittingly protrude through the first slot-shaped opening and the second end panel is dimensioned to fittingly protrude through the second slot-shaped opening such that the length of the center panel extends from the first wall of the container to the second wall of the container, the first and second planar end panels overlapping and being fixedly secured to the garment container.

2. The garment hanger system of claim 1 wherein the garment container comprises:

a base;

a plurality of walls extending from the base to define an interior volume; and a cover element extending from each of the plurality of walls to selectively enclose the interior volume.

3. The garment hanger system of claim 2 wherein the first slot-shaped opening is formed in a first wall of the plurality of walls and the second slot-shaped opening is formed in a second wall of the plurality of walls.

4. The garment hanger system of claim 3 wherein the first and second walls directly oppose one another.

5. The garment hanger system of claim 4, wherein:

the first end panel is fixedly secured to the first wall of the garment container by at least one of adhesive and tape; and the second end wall is fixedly secured to a cover element of the garment container by at least one of adhesive and tape.

6. The garment hanger system of claim 5, wherein:

the center panel is positioned within the interior volume of the garment container;

at least a portion of the first end panel is disposed through the first opening in the first wall and folded about the first hinge joint in a first direction relative to the center panel; and at least a portion of the second end panel is disposed through the second opening in the second wall of the garment container and folded in the first direction about the second hinge joint relative to the center panel to capture a pair of the cover elements of the garment container there between.

7. The garment hanger system of claim 1 wherein the at least one set of openings defined by the center panel includes a pair of openings disposed in a side-by-side relationship.

8. The garment hanger system of claim 7 wherein the pair of openings includes a first opening configured as a substantially circular opening and a second opening configured as an elongated slot, the elongated slot being elongated along a vertical axis of the unitary structure.

9. The garment hanger system of claim 7 wherein the pair of openings includes a first opening and a second opening configured as substantially circular openings.

10. The garment hanger system of claim 1 wherein the at least one set of openings defined by the center panel includes multiple pairs of openings which are equidistantly arranged along a length of the center panel, each pair of openings being disposed in a side-by-side relationship.

* * * * *